United States Patent [19]

Hackney

[11] 4,319,537

[45] Mar. 16, 1982

[54] SAILCRAFT TRAVELER CAR AND ASSEMBLY

[76] Inventor: John Hackney, 1026 NW. 16th St., Stuart, Fla. 33494

[21] Appl. No.: 144,045

[22] Filed: Apr. 25, 1980

[51] Int. Cl.[3] ..... B63B 21/04; B63H 9/10

[52] U.S. Cl. ..... 114/112; 114/111; 114/204; 114/218; D8/356; 410/104

[58] Field of Search ..... 114/111, 112, 204, 218, 114/205; 24/115 G, 68 C, 68 D; 248/68 CB; D8/356; 410/104, 109, 115

[56] References Cited

U.S. PATENT DOCUMENTS

| | | | |
|---|---|---|---|
| 3,503,359 | 3/1970 | Cornwell, Jr. | 114/218 |
| 4,013,031 | 3/1977 | Viviano | 114/204 |
| 4,059,063 | 11/1977 | Hood et al. | 114/111 |

*Primary Examiner*—George E. A. Halvosa
*Assistant Examiner*—C. T. Bartz
*Attorney, Agent, or Firm*—Carroll F. Palmer

[57] ABSTRACT

A traveler assembly for a sailboat or other sailcraft comprises a car slotted to ride in the traveler track and having a pair of transverse major holes in the middle thereof and a transverse minor hole on each end. A sheet for a sail of the sailcraft is bent to one of the major holes and reeved via the sail through the other major hole. Lines bent to the minor holes permit positioning of the car along the track to be instantly controlled from a position on the sailcraft remote from the traveler, e.g., if the sail is a jib sheeted down on the leeward side, the traveler position may be controlled from the windward side of the sailcraft.

10 Claims, 8 Drawing Figures

FIG. 3
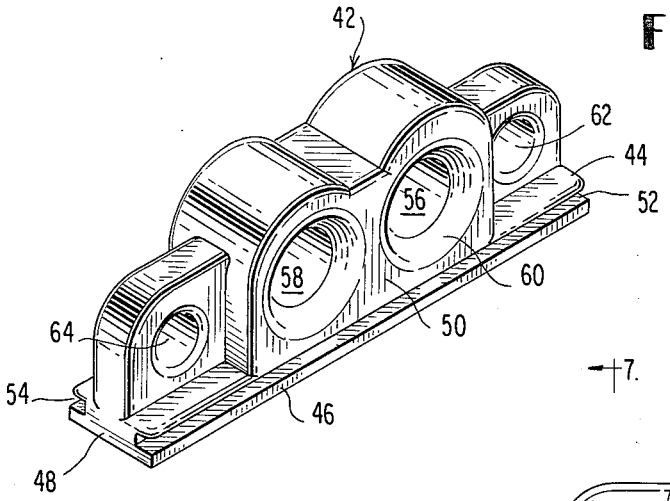
FIG. 4
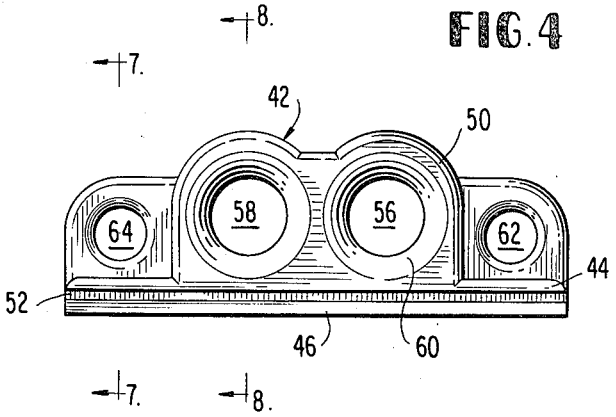
FIG. 5
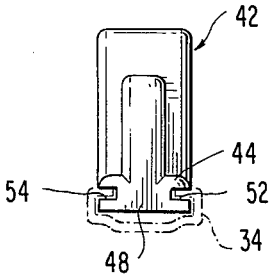
FIG. 6
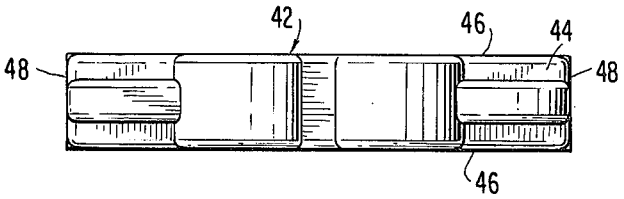
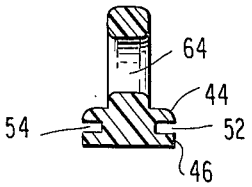
FIG. 7
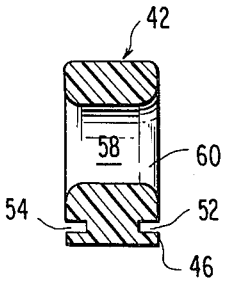
FIG. 8

SAILCRAFT TRAVELER CAR AND ASSEMBLY

BACKGROUND OF THE INVENTION

1. Field of the Invention

Broadly the invention relates to travelers for sailcraft. More particularly, it concerns improved forms of cars for traveler assemblies that enable traveler positioning to be controlled from a position on the sailcraft remote from the traveler.

2. Description of the Prior Art

A sailcraft traveler is a device that helps to fix the angle relative to the longitudinal axis of the sailcraft that a sheet will lead to a sail for controlling the set of the sail. Travelers are used not only on sailboats, but also on iceboats, wind scooters and other sailcraft. In many sailcraft, a traveler is used only with a mainsail, but with others, e.g., racing catamarans, travelers are used with both a mainsail and a jib. The improvements of this invention may be used on both mainsail and jib travelers.

The simplest forms of travelers consist of a ring or sheave that slides along a rod or rope fastened to the deck of the sailcraft. In the more advanced forms of travelers, a track is fastened generally perpendicular to the longitudinal axis on the deck or other portion of the sailcraft and a car slides along the track. This invention relates to travelers of the type that include such a track.

In order to adjust the sheeting angle of a sail, it is necessary to control the position of the car on the traveler track. In many forms of travelers, this is done using stops or bumpers that are secured at a selected position on the track by a wing-nut, plunger or the like. To alter the sheeting angle with such type of traveler assembly requires that the stop or bumper be changed to a new position on the track. This requires a person to move to the traveler, but this is undesirable with high performance racing sailboats, particularly when beating to windward, because of the shift in weight distribution on the sailcraft. Accordingly, various systems have been developed by which the position of the car on the traveler track can be controlled by lines or other means from a point on the sailcraft remote from the traveler. This invention relates to improvements in such remote control traveler systems.

OBJECTS

A principal object of the present invention is the provision of improved forms of traveler assemblies for sailcraft.

Another object is the provision of an improved form of car for the track of a sailcraft traveler.

A further object is the provision of traveler assemblies particularly suited for use in sheeting control of jibs on racing catamaran sailboats.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

These objects are accomplished according to the present invention by the provision of a car for a traveler track that comprises a rectangular base portion and a body portion integral with the base portion that extends upward from and perpendicular to the base portion. The sides of the car are slotted to receive runners of the track. There is a first pair of parallel cylindrical holes transversely through the body portion and a second pair of holes separated from one another by the first pair.

A traveler assembly equipped with such a car has a sheave fixed at an end of the traveler track, first cam cleat fixed along one side of the track inboard of such sheave and second cam cleat fixed along the same side of the track inboard of the first cam cleat. A car control line is fixed at one end to the outboard hole of the second pair of holes in the car, reeved through the sheave and then through the second cam cleat. A sail sheet is bent to the outboard hole of the first pair of holes in the car and passed, thence in turn, to a sail or boom, to the other hole of the first pair and finally to the first cam cleat.

A preferred use of the new traveler assemblies is the control of sheeting of a jib on a racing catamaran sailboat. In such an installation, two blocks are fixed to the jib clew and the traveler assembly has a pair of cars carried on the track and a pair of cam cleats as described above near each end of the track. One jib sheet is rigged as described on one car and through one of the jib blocks. A second jib sheet is rigged through the second car at the other end of the track and through the second of the jib blocks. With such an arrangement, the position of a car can be controlled by a person at the windward side of the sailboat while the jib is sheeted down on the leeward side thereby avoiding the need to move to leeward in order to change the traveler setting.

BRIEF DESCRIPTION OF THE DRAWINGS

A more complete understanding of the present invention may be had by reference to the accompanying drawings in which:

FIG. 3 is an isometric view of an improved traveller car of the invention.

FIG. 4 is a lateral view of the traveller car of FIG. 3.

FIG. 5 is a end view of the traveller car of FIG. 3.

FIG. 6 is a plan view of the traveller car of FIG. 3.

FIG. 7 is a sectional view taken on the line 7—7 of FIG. 4.

FIG. 8 is a sectional view taken on the line 8—8 of FIG. 4.

DESCRIPTION OF PREFERRED EMBODIMENTS

Figure 1:
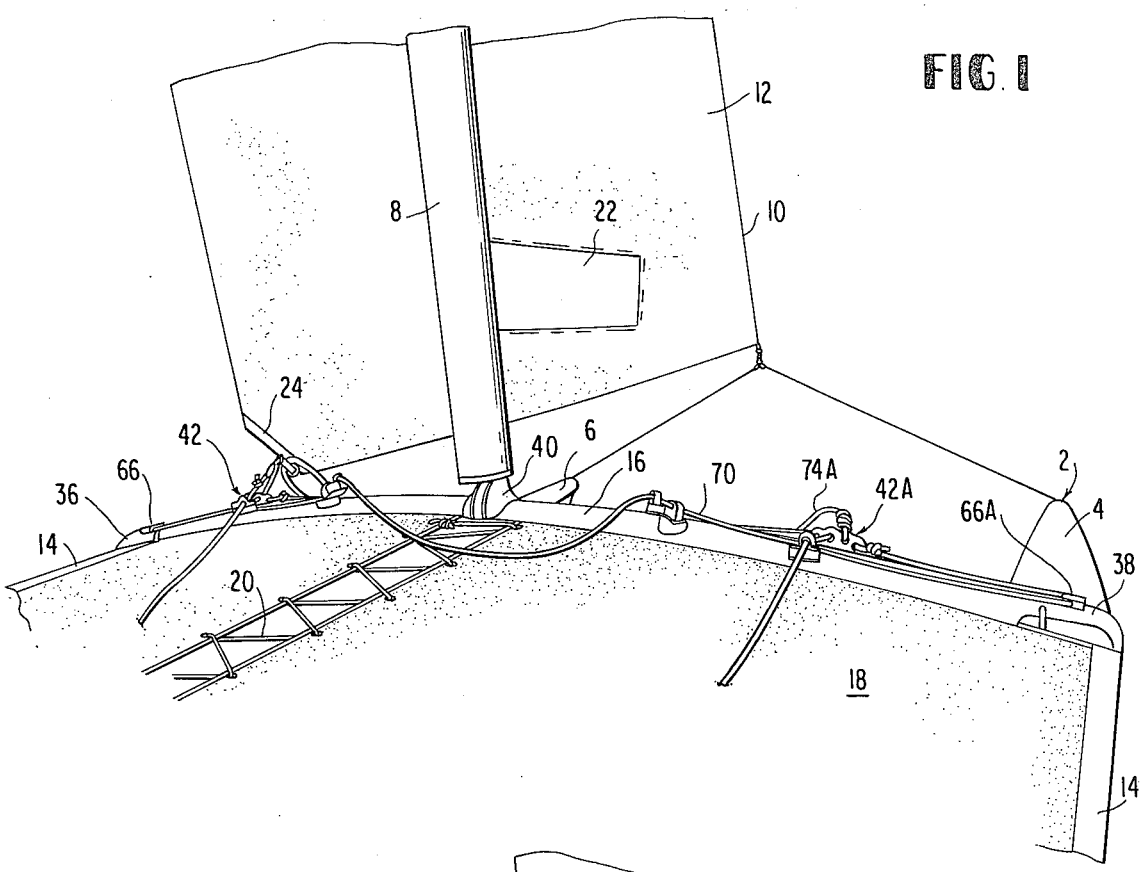
FIG. 1 is a fragmentary, perspective view of a portion of a catamaran sailboat equipped with a traveller assembly of the invention.

Referring in detail to the drawings in which identical parts are identified by the same numeral, the sailboat 2 comprises a starboard hull 4, port hull 6, mast 8, forestay 10, jib 12, longitudinal deck frame members 14, transverse fore deck frame member 16 and fabric decking 18 stretched across the frame members 14 by the lacing 20.

The jib 12 comprises the sight window 22, clew bar 24 and a pair of blocks 26 and 28 fixed to the clew bar 24 by shackle 30 that extends through one of the holes 32 in the clew bar.

The transverse frame member 16 carries traveler track 34 which may be held by fasteners (not shown) to the frame member. Alternatively, the track may be an integral part of the frame member 16 (not shown) created when the frame member 16 is formed such as by extrusion of aluminum alloy or the like. The track 34 may be in one piece extending from the port end 36 to the starboard end 38 of frame member 16. Alternatively, the track may be made in two sections which terminate at their inboard ends (not shown) outboard of the tabernacle 40 of the mast 8. The ends of the traveler track 34 may be stopped by bumpers, plugs or the like that advantageously can be removed to enable a traveler car to be inserted into or removed from the track.

Figure 2:
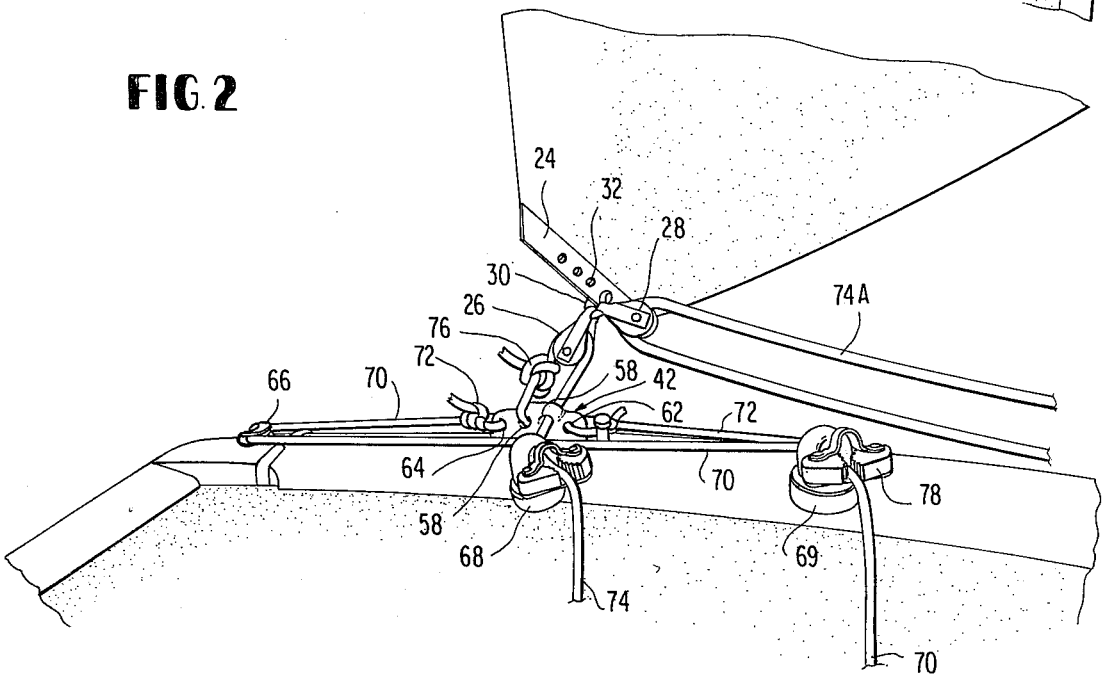
FIG. 2 is an enlarged, fragmentary view of the port side of the sailboat shown in FIG. 1 showing the port side portion of the traveller assembly for the jib of the sailboat.

A variety of shapes and sizes of traveler tracks may be used for the traveler assemblies of the invention, so the arrangement shown in FIGS. 1 and 2 is by way of illustration only. Further, while FIGS. 1 and 2 illustrate the use of the new traveler assemblies for sheeting a jib, they are equally useful for controlling the boom of a mainsail or mizzen. The cross-section of the track may be varied and it may be made of metal, plastic or other suitable material. Track in the form of metal channel is preferred.

A traveler car 42 of the invention comprises a rectangular base portion 44, a pair of parallel longitudinal sides 46 and a pair of parallel narrow ends 48. There is a body portion 50 integral with the base portion 44 that extends upwardly from and perpendicular to the base portion 44.

A first longitudinal slot 52 runs along the entire length of one of the sides 46 and a second longitudinal slot 54 runs along the other side of the base portion 44.

A first pair of parallel cylindrical holes 56 and 58 extend transversely to the major axis of the car 42 through the body portion 50. The entrances 60 to the holes 56 and 58 at each side of the car 42 are well chamfered to allow lines reeved through the holes to move easily through them.

A second pair of transverse cylindrical holes 62 and 64 extend through the body portion 50 separated from one another by the holes 56 and 58. The size of the holes 56 and 58 are substantially identical. So are the holes 62 and 64 but the latter are substantially smaller in diameter than the former.

The height and cross-section of the body portion through which the holes 56 and 58 extend is substantially greater than the height and cross-section of the body portion through which the holes 62 and 64 extend. Also, the central axes of holes 56 and 58 are further from the car base portion 44 than are the central axes of holes 62 and 64.

A traveler assembly of the invention basically comprises the track 34, the improved car 42 carried in the track, a sheave 66 positioned at the outboard end of the track 34, a first cam cleat 68 positioned along one side of the track inboard of the sheave 66 and a second cam cleat 69 positioned along the same side of the track 34.

The traveler assembly is rigged with a control line 70 bent at one end 72 to hole 64 of car 42. The line 70 is reeved through the sheave 66 and through the cam cleat 69. A biasing element, such as elastic cord 72 is fixed to the car 42 via hole 62. The cord 72 serves to pull the car inboard when tension on the control line 70 is released.

The port jib sheet 74 is bent at one end 76 to the hole 58 of car 42 and is then reeved, in turn, through the jib block 26, the car hole 58 and the cam cleat 68.

The position of the car 42 can be controlled from any suitable position on the sailboat 2 by means of the control line 70. If it is desired to move the car outboard to sheet the jib 12 further to port, this is done by pulling on line 70 which moves the car 42 closer to sheave 66, against the biasing pull of elastic cord 72. To move the car inboard to sheet the jib 12 closer to the centerline of sailboat 2, control line 70 is released by pulling it up out of the cam jaws 78 of cam cleat 69 and allowing it to run far enough to enable the car 42 to be pulled by cord 72 the desired distance inboard. At this point, the control line 70 is reinserted into the cam jaws 78 to cleat and hold the line 70 at the adjusted position.

With the car 42, held in a desired controlled position as described, the jib sheet 74 may be played through the car hole 58 and block 26 by releasing the sheet 74 from the cam cleat 68. This adjusts the tensioning of the jib 12, while the position of the car 42 fixes the angle at which such tension is applied to the jib 12 relative to the longitudinal axis of the boat 2 (the sheeting angle).

In the complete jib sheeting arrangement shown in FIGS. 1 and 2, the sailboat jib 12 carries the two blocks 26 and 28. A second traveler comprising a car 42A and sheave 66A is provided on the starboard side of the boat above the hull 4. This second traveler assembly is rigged with control line 70 and jib sheet 74A in a manner similar to that described for traveler car 42.

The traveler cars of the invention are easily installed on pre-existing track to replace units not capable of long-distance control as with the new cars. The new cars can be fabricated from any suitable material, but cars formed by injection molding of high-impact, abrasion resistant plastic are preferred. Such cars slide easily in metal channel track and allow the jib sheets, control lines or the like to feed easily through the car holes.

Use of the new traveler assemblies for control of mainsails, mizzens or the like can easily be arranged by users of sailcraft interested in obtaining maximum performance from their craft.

The embodiments of the invention in which an exclusive property or privilege is claimed are defined as follows:

1. A car for the track of a sailcraft traveler which comprises:

a rectangular base portion having a substantially flat bottom surface, a pair of parallel longitudinal sides and a pair of parallel narrow ends, a body portion integral with said base portion that extends upwardly from said base portion and perpendicular thereto, a first longitudinal slot along the entire length of one of said longitudinal sides positioned between said bottom surface and said body portion, a second longitudinal slot similar to said first slot along the other side of said base portion, a first pair of parallel cylindrical holes through said body portion transverse to the major axis of said body portion, the entrances to said holes on each side of said body portion being well chamfered, a second pair of transverse cylindrical holes through said body portion separated from one another by said first pair of holes, the size of said first pair of holes being substantially identical, and the size of said second pair of holes being substantially identical and substantially smaller than the size of said first pair.

2. The car of claim 1 wherein the height and cross-section of said body portion through which said first pair of holes extend is substantially greater than the height and cross-section of said body portion through which said second pair of holes extend.

3. The car of claim 2 wherein the central axis of said first pair of holes is further from said base portion than the central axis of said second pair of holes.

4. A traveler assembly for a sailcraft comprising:

a channelled elongated track, a car as defined in claim 1 carried in said track, a sheave positioned at the outboard end of said track, a first cam cleat positioned along one side of said track inboard of said sheave, and a second cam cleat positioned along said one side of said track inboard of said first cam cleat.

5. The traveler assembly of claim 4 wherein a line, fixed at one end to the outboard one of the holes of said second pair of holes in said car, is passed around said sheave and through said second cam cleat.

6. The traveler assembly of claim 5 which is fitted to a sailcraft carrying a jib.

7. The traveler assembly of claim 6 wherein said jib has a block fixed to its clew.

8. The traveler assembly of claim 7 wherein a jib sheet, fixed at one end to one of the holes of said first pair of holes passes, in turn, through said jib block, the other of the holes of said first pair of holes and thence through said first cam cleat.

9. The traveler assembly of claim 8 wherein said car is biased to move inboard along said track by elastic cord fixed at one end to the inboard one of said holes of said second pair of holes.

10. A sailcraft carrying a jib having two blocks fixed to its clew, a first traveler assembly as defined in claim 9 with its jib sheet reeved through one of said two blocks and a second traveler assembly as defined in claim 9 with its jib sheet reeved through the second of said two blocks.

* * * * *